US011759830B2

(12) United States Patent
Zhang

(10) Patent No.: US 11,759,830 B2
(45) Date of Patent: Sep. 19, 2023

(54) ELECTRIC DUST BLOWER AND MODULAR ASSEMBLY METHOD THEREOF

(71) Applicant: Junliang Zhang, Guangzhou (CN)

(72) Inventor: Junliang Zhang, Guangzhou (CN)

( * ) Notice: Subject to any disclaimer, the term of this patent is extended or adjusted under 35 U.S.C. 154(b) by 0 days.

(21) Appl. No.: 18/301,833

(22) Filed: Apr. 17, 2023

(65) Prior Publication Data

US 2023/0249229 A1 Aug. 10, 2023

(51) Int. Cl.

| | |
|---|---|
| ***B08B 5/02*** | (2006.01) |
| ***B08B 13/00*** | (2006.01) |
| ***F04D 25/06*** | (2006.01) |
| ***A47L 5/24*** | (2006.01) |
| ***A47L 5/14*** | (2006.01) |
| ***B05B 1/00*** | (2006.01) |
| ***A47L 9/32*** | (2006.01) |
| ***A47L 9/22*** | (2006.01) |
| ***A47L 9/28*** | (2006.01) |
| ***A47L 9/30*** | (2006.01) |
| ***F04D 29/54*** | (2006.01) |

(52) U.S. Cl.

CPC ..... *B08B 5/02* (2013.01); *A47L 5/14* (2013.01); *A47L 5/24* (2013.01); *B08B 13/00* (2013.01); *F04D 25/0673* (2013.01); *F04D 29/541* (2013.01); *A47L 9/22* (2013.01); *A47L 9/2857* (2013.01); *A47L 9/2884* (2013.01); *A47L 9/30* (2013.01); *A47L 9/322* (2013.01); *B05B 1/005* (2013.01)

(58) Field of Classification Search

CPC ... B08B 5/02; B08B 13/00; A47L 5/14; A47L 5/24; A47L 9/22; A47L 9/2857; A47L 9/2884; A47L 9/30; A47L 9/322; F04D 25/0673; F04D 29/541; B05B 1/005

USPC ..... 15/330, 344, 405, 339

See application file for complete search history.

(56) References Cited

U.S. PATENT DOCUMENTS

| | | | | |
|---|---|---|---|---|
| 3,647,323 | A * | 3/1972 | Thomas | H02K 7/14 415/206 |
| 4,366,368 | A * | 12/1982 | Stephens, III | F24H 3/062 392/385 |
| 4,734,017 | A * | 3/1988 | Levin | H02K 7/145 D32/15 |
| 6,092,260 | A * | 7/2000 | Kai | B05B 7/2435 239/289 |
| 7,841,045 | B2 * | 11/2010 | Shaanan | A47L 5/14 15/246 |
| 2004/0107584 | A1 | 6/2004 | Yoshida et al. | |
| 2005/0262706 | A1 | 12/2005 | Yoshida et al. | |
| 2011/0211312 | A1 | 9/2011 | Senoh et al. | |

FOREIGN PATENT DOCUMENTS

WO WO2014010838 * 2/2004

* cited by examiner

*Primary Examiner* — David Redding

(74) *Attorney, Agent, or Firm* — Zhigang Ma

(57) ABSTRACT

The present disclosure discloses an electric dust blower which includes a shell, a control panel, a battery module, a fan, an illumination lamp, and air outlet nozzles, where the shell includes two half shells capable of being spliced together left and right; the battery module is disposed at a lower portion of a mounting chamber; the fan is disposed at a rear portion of an air chamber and is close to an air inlet; the illumination lamp is mounted in a mounting hole and exposed out of a front end face of a main body; and the air outlet nozzles are detachably mounted at and connected to an air outlet.

10 Claims, 5 Drawing Sheets

ELECTRIC DUST BLOWER AND MODULAR ASSEMBLY METHOD THEREOF

TECHNICAL FIELD

The present disclosure relates to the technical field of dust blowers, and particularly to an electric dust blower and a modular assembly method thereof.

BACKGROUND

Dust blowers are mainly used for dust removal in home life and are most suitable for use in some sanitary dead corners. It is difficult for conventional cleaning products to clean some small places such as corners, etc., so the dust blowers come into being. A dust blower generates a high-speed air flow through a fan, and blows out the high-speed air flow through a blowing nozzle to generate powerful and accurate wind which drives surrounding air to operate together, such that dirt in the narrow space is blown out, which is conductive to subsequent cleaning.

In daily work and life, electronic products such as keyboards and mice often have dust deposited in gaps, and are not easy to clean, which not only affects the aesthetics but also affects the performance of the products after long-term use. In this case, the dust blowers may play their best role.

At present, a motor and a battery are the two major components with the largest proportion of weight in a dust blower. In the prior art, due to unreasonable position design of the two major components, the overall center of gravity of the dust blower does not coincide with a position held by a user, which makes the dust blower prone to shaking, poor in handheld stability, and not convenient to use. Moreover, a welding operation is required for connection between each electrical component and a control panel, resulting in complex and low-efficiency assembly. In addition, the current dust blower produces a large noise in the using process. Therefore, it is necessary to improve the existing dust blower.

SUMMARY

In view of this, aiming at the defects in the prior art, the main objective of the present disclosure is to provide an electric dust blower and a modular assembly method thereof, which can effectively solve the problems that an existing dust blower is poor in handheld stability, complex in assembly trouble, and large in noise.

In order to achieve the above objective, the present disclosure adopts the following technical solutions:

An electric dust blower includes a shell, a control panel, a battery module, a fan, an illumination lamp, and air outlet nozzles;

the shell includes two half shells capable of being spliced together left and right; upper portions of the two half shells are spliced to form a main body; an air chamber is disposed in the main body; an inner diameter of the air chamber is gradually reduced from rear to front; an air inlet communicated with a rear end of the air chamber is disposed at a rear end face of the main body; a mounting hole and an air outlet communicated with a front end of the air chamber are disposed at a front end face of the main body; the mounting hole is located beside the air outlet; lower portions of the two half shells are spliced to form a handle, the handle integrally extends downwards out of a side face of a rear end of the main body; and a mounting chamber is disposed within the handle;

the control panel is disposed at an upper portion of the mounting chamber; the control panel has a first interface, a second interface, a third interface, and a control switch; and the control switch is exposed out of a front side face of an upper end of the handle;

the battery module is disposed at a lower portion of the mounting chamber; the battery module has a first connecting line that has a first plug at a tail end; and the first plug is in plug-in connection with the first interface for conduction;

the fan is disposed at a rear portion of the air chamber and is close to the air inlet; the fan has a second connecting line that has a second plug at a tail end; and the second plug is in plug-in connection with the second interface for conduction;

the illumination lamp is mounted in the mounting hole and exposed out of the front end face of the main body; the illumination lamp has a third connecting line that has a third plug at a tail end; and the third plug is in plug-in connection with the third interface for conduction; and the air outlet nozzles are detachably mounted at and connected to the air outlet.

Preferably, the fan includes a motor, an air guide rear cover, an air guide front housing, and an impeller, where the motor is fixed in the air chamber; the air guide rear cover is fixed to a front end of the motor, and a plurality of air guide holes are provided at a periphery of the air guide rear cover; the air guide front housing is located on a front side of the air guide rear cover and spliced with the air guide rear cover to define a cavity; an air inlet hole communicated with the cavity is provided at a center of a front end of the air guide front housing; the air inlet hole is opposite to the air inlet; the air guide front housing is wrapped with an anti-vibration sponge that is clamped between an outer wall of the air guide front housing and an inner wall of the air chamber; and the impeller is fixed to an output shaft of the motor and located in the cavity.

Preferably, a rear end of the motor faces the air outlet, and vibration-damping silicone components are sandwiched between an outer wall of the rear end of the motor and the inner wall of the air chamber.

Preferably, the number of the vibration-damping silicone components is two, and the two vibration-damping silicone components are symmetrically disposed in a radial direction; clamping portions are disposed on inner walls of the two half shells in a protruding manner; and the two vibration-damping silicone components are respectively clamped to the corresponding clamping portions for fixation.

Preferably, an accommodating slot is provided inside a front end of the main body, a sound-absorbing sponge is placed in the accommodating slot, and the sound-absorbing sponge is located behind the air outlet.

Preferably, an air inlet grill is sandwiched between rear ends of the upper portions of the two half shells, and the air inlet grill is located behind the air inlet.

Preferably, positioning slots and a buckle slot are provided in an outer wall of a lower end of the handle in a concave manner, the shell further includes a bottom cap, positioning portions and a buckle portion are provided on an inner wall of the bottom cap in a protruding manner, the positioning portions are inserted into the positioning slots for positioning, and the buckle portion is fit with the buckle slot for buckling and fixation.

Preferably, the control panel has a charging interface, and the charging interface is exposed out of a rear side face of the upper end of the handle.

Preferably, a plurality of air outlet nozzles are provided, including a first air outlet nozzle, a second air outlet nozzle, a third air outlet nozzle, a fourth air outlet nozzle, and a fifth air outlet nozzle respectively; the first air outlet nozzle, the second air outlet nozzle, the third air outlet nozzle, the fourth air outlet nozzle and the fifth air outlet nozzle are respectively detachably disposed at the air outlet, where the first air outlet nozzle and the second air outlet nozzle are conical, an output end of the first air outlet nozzle and an output end of the second air outlet nozzle are circular, and a length of the first air outlet nozzle is greater than a length of the second air outlet nozzle; an output end of the third air outlet nozzle is oval; a front end of the fourth air outlet nozzle is flat, and air outlet holes communicated with an air duct inside the fourth air outlet nozzle are provided on two sides of the front end of the fourth air outlet nozzle; and bristles are disposed at a periphery of an output end of the fifth air outlet nozzle.

A modular assembly method of an electric dust blower includes the following steps:

(1) preparing a shell, a control panel, a battery module, a fan, an illumination lamp, and air outlet nozzles;

(2) taking one of half shells, and fixing the control panel, the battery module, the fan and the illumination lamp to corresponding positions on the half shell respectively;

(3) plugging a first plug, a second plug and a third plug to a first interface, a second interface and a third interface respectively for conduction;

(4) splicing and fixing the other half shell and the half shell of step (2) together; and (5) performing plug-in connection and fixation on the air outlet nozzles and an air outlet.

Compared with the prior art, the present disclosure has remarkable advantages and beneficial effects. Specifically, it can be seen from the above technical solutions that:

Firstly, since the battery module is disposed at the lower portion of the mounting chamber, and the fan is disposed at the rear portion of the air chamber and is close to the air inlet, the overall center of gravity of this product coincides with a handheld part of the handle, and the product is not prone to shaking when held by a hand, thereby having better stability and being more convenient to use. Meanwhile, by disposing various interfaces on the control panel, the plugs of the battery module, the fan and the illumination lamp are plugged to the corresponding interfaces respectively, such that the modular assembly is achieved, the welding operation is not required, the assembly is easier and more convenient, and the assembly efficiency is effectively improved.

Secondly, the impeller is disposed in the cavity formed by the air guide rear cover and the air guide front housing, the anti-vibration sponge and the vibration-damping silicone components are disposed to absorb noise generated by the fan, and meanwhile, the sound-absorbing sponge is disposed to absorb noise generated by the air flow, such that the noise generated by the product is effectively reduced, a mute effect is achieved, and the use performance of the product is greatly improved.

DESCRIPTION OF REFERENCE NUMERALS

| | |
|---|---|
| 10. Shell | 11. Half shell |
| 111. Clamping portion | 12. Sound-absorbing sponge |
| 13. Air inlet grill | 14. Bottom cap |
| 141. Positioning portion | 142. Buckle portion |
| 101. Air chamber | 102. Air inlet |
| 103. Mounting hole | 104. Air outlet |
| 105. Mounting chamber | 106. Accommodating slot |
| 107. Positioning slot | 108. Buckle slot |
| 20. Control panel | 21. First interface |
| 22. Second interface | 23. Third interface |
| 24. Control switch | 25. Charging interface |
| 30. Battery module | 31. First connecting line |
| 32. First plug | 40. Fan |
| 41. Motor | 411. Output shaft |
| 42. Air guide rear cover | 421. Air guide hole |
| 43. Air guide front housing | 431. Cavity |
| 432. Air inlet hole | 44. Impeller |
| 45. Anti-vibration sponge | 46. Vibration-damping silicone component |
| 401. Second connecting line | 402. Second plug |
| 50. Illumination lamp | 51. Third connecting line |
| 52. Third plug | 60. Air outlet nozzle |
| 61. First air outlet nozzle | 62. Second air outlet nozzle |
| 63. Third air outlet nozzle | 64. Fourth air outlet nozzle |
| 641. Air outlet hole | 65. Fifth air outlet nozzle |
| 651. Bristle | |

DETAILED DESCRIPTION

Figure 1:
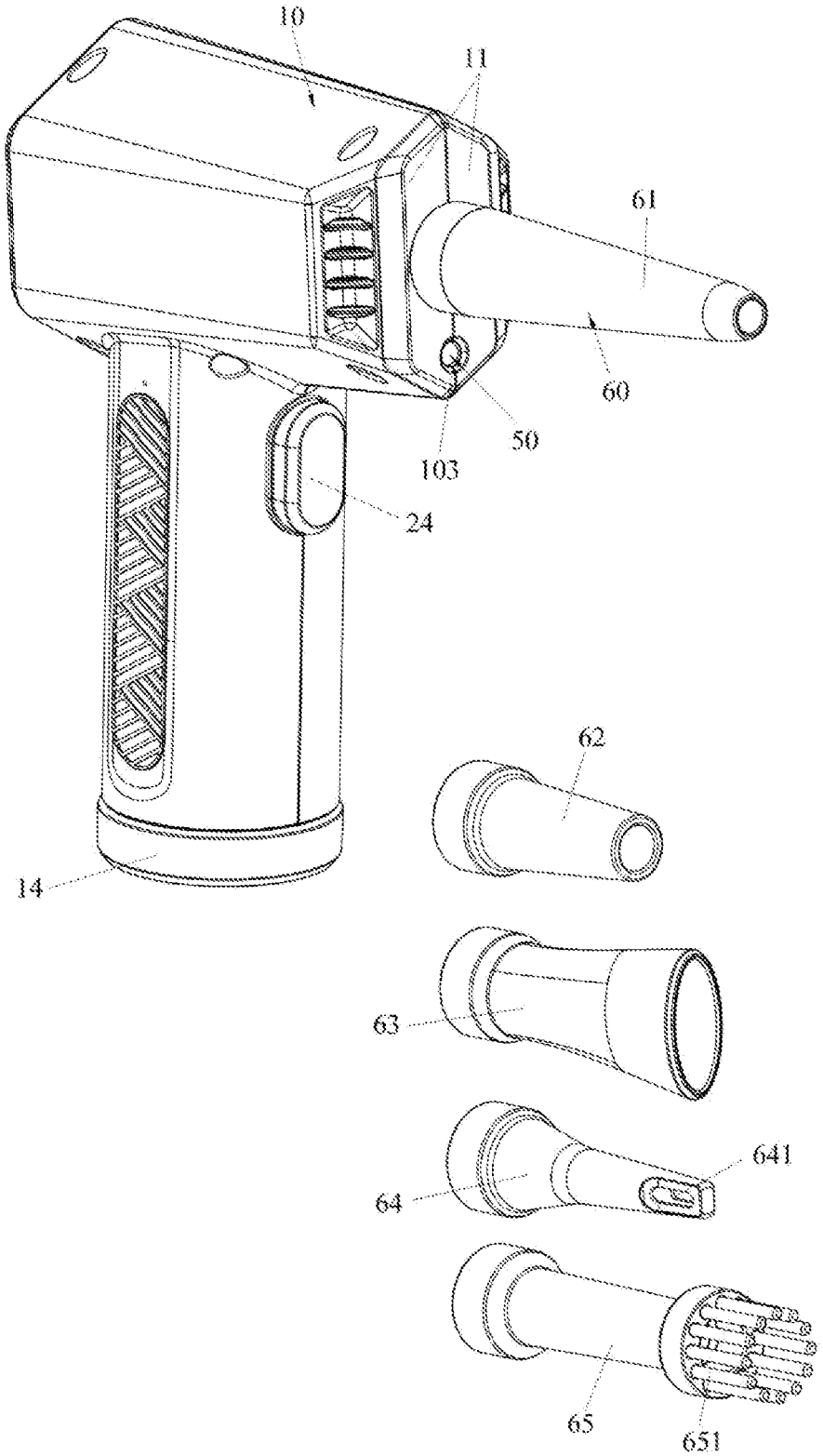
FIG. 1 is a perspective assembly diagram of a preferred embodiment of the present disclosure.
Figure 2:
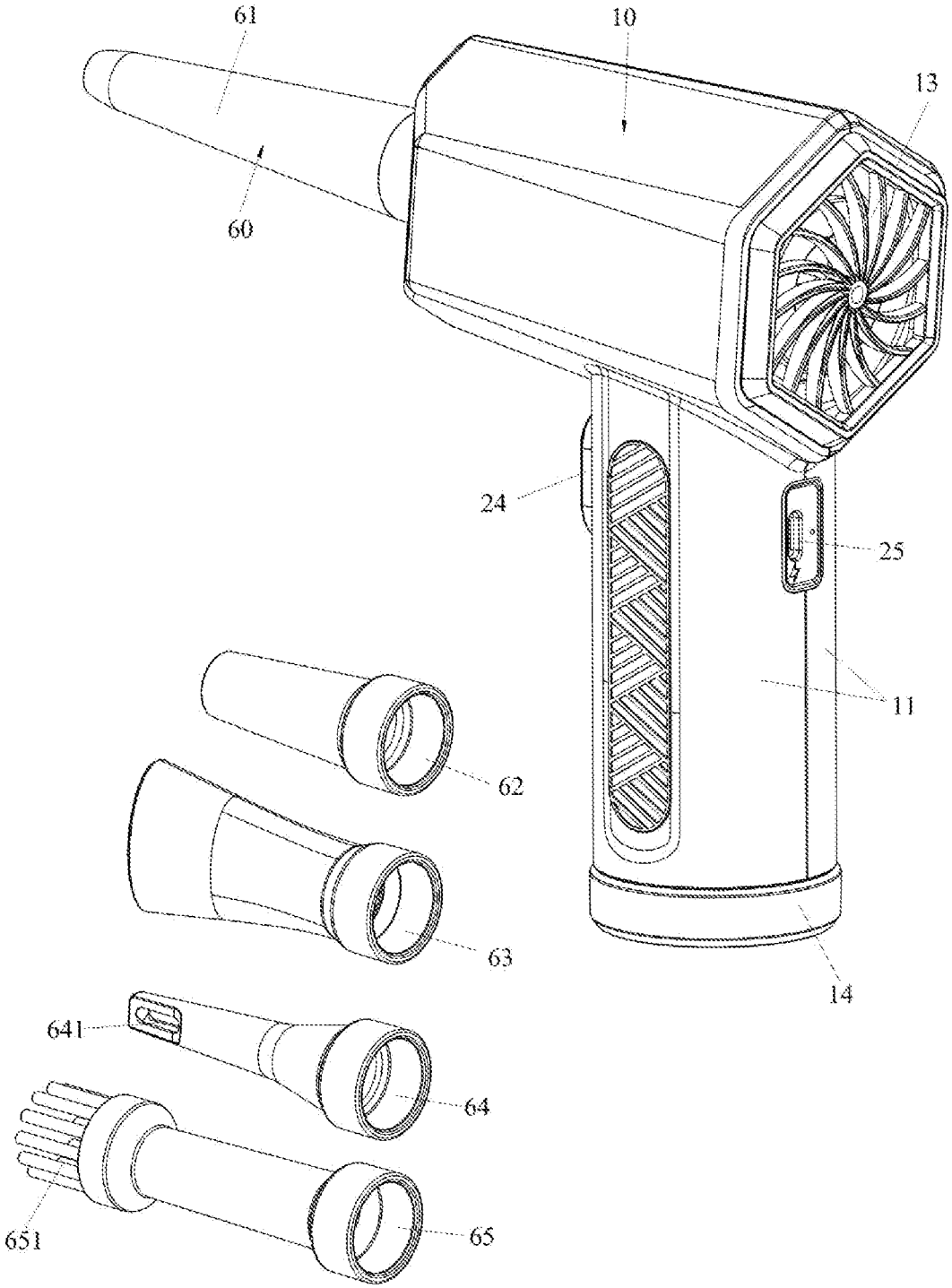
FIG. 2 is a perspective assembly diagram from another angle of a preferred embodiment of the present disclosure.
Figure 3:
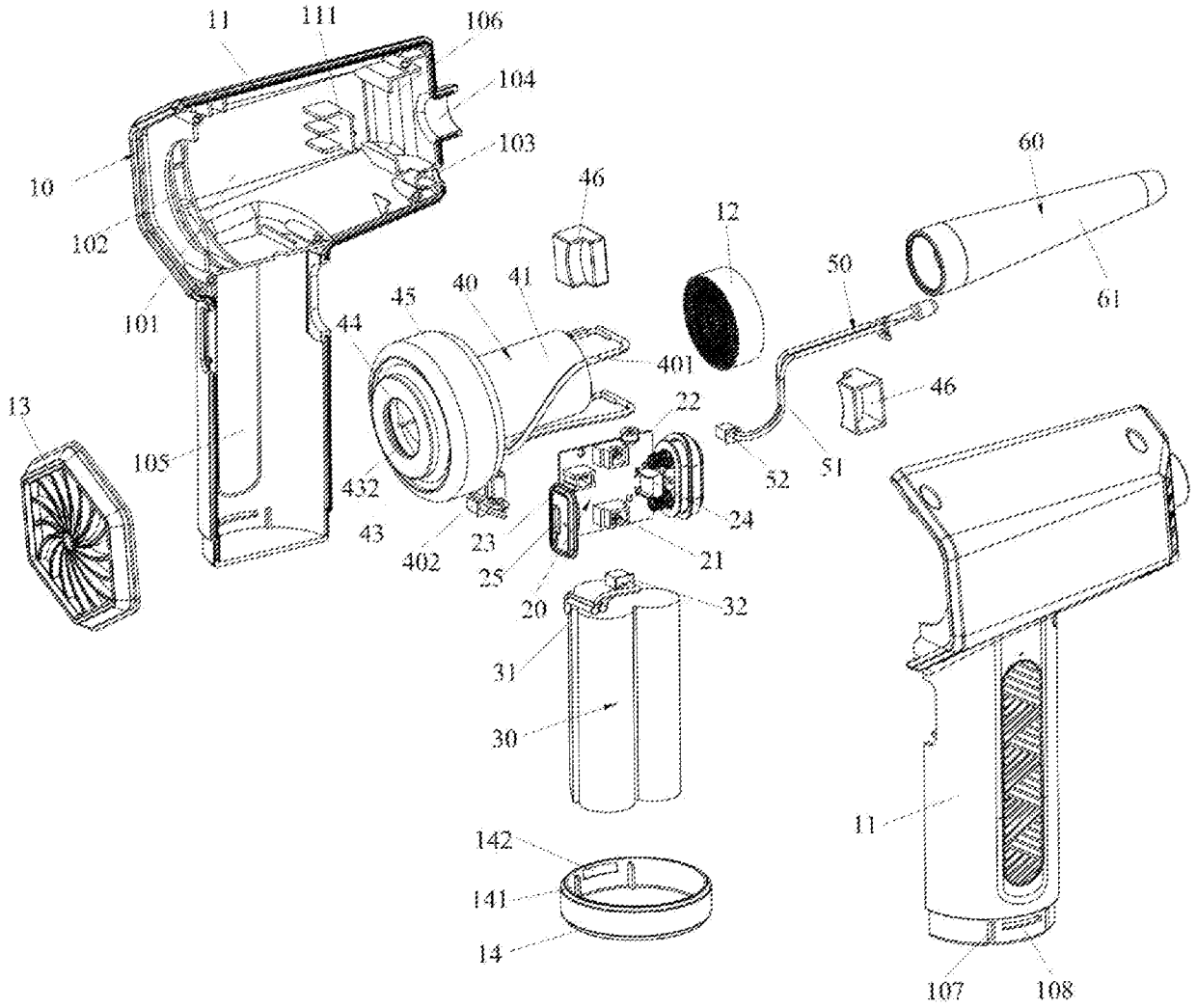
FIG. 3 is an exploded view of a preferred embodiment of the present disclosure.
Figure 4:
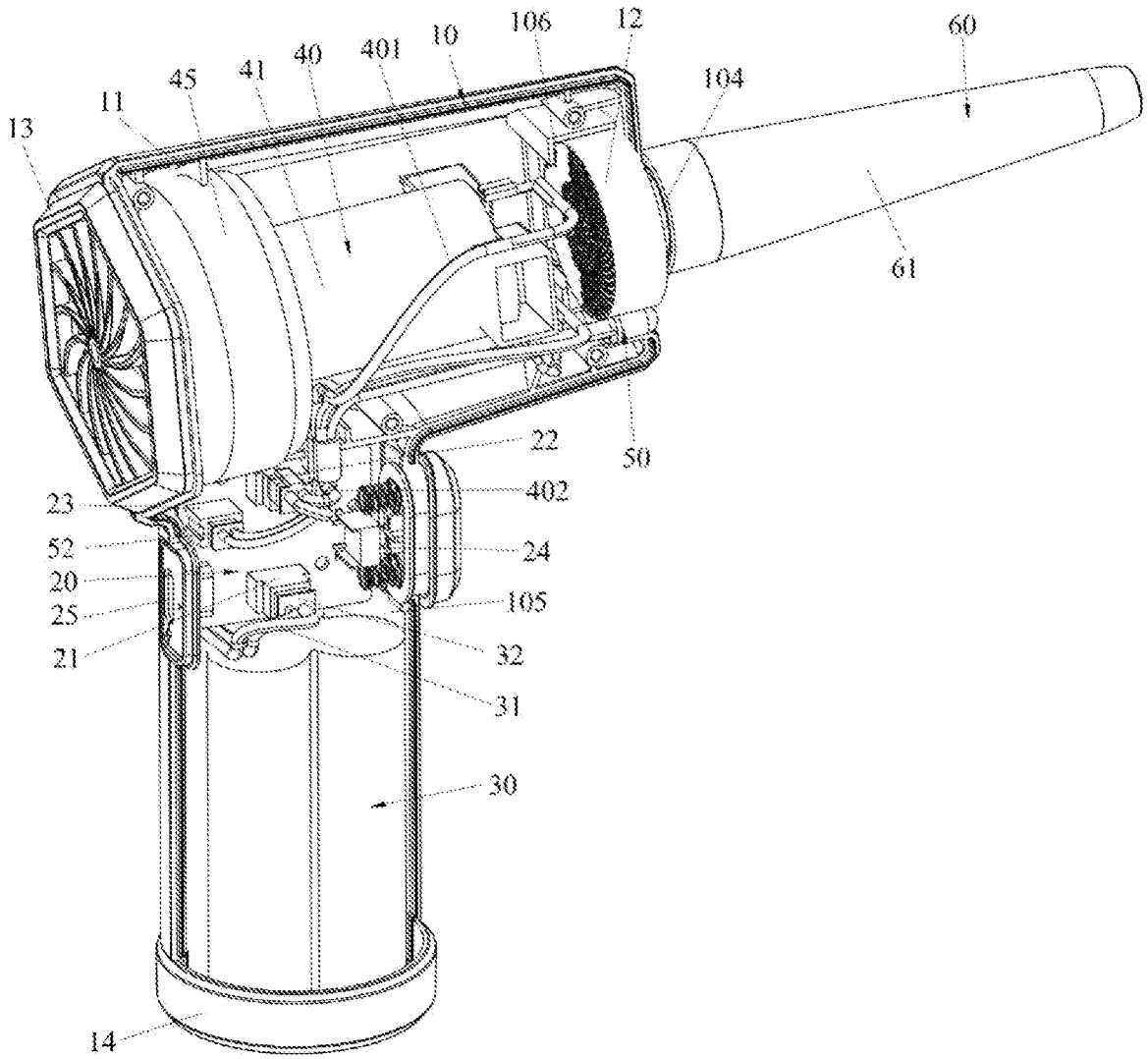
FIG. 4 is a partial assembly diagram of a preferred embodiment of the present disclosure.
Figure 5:
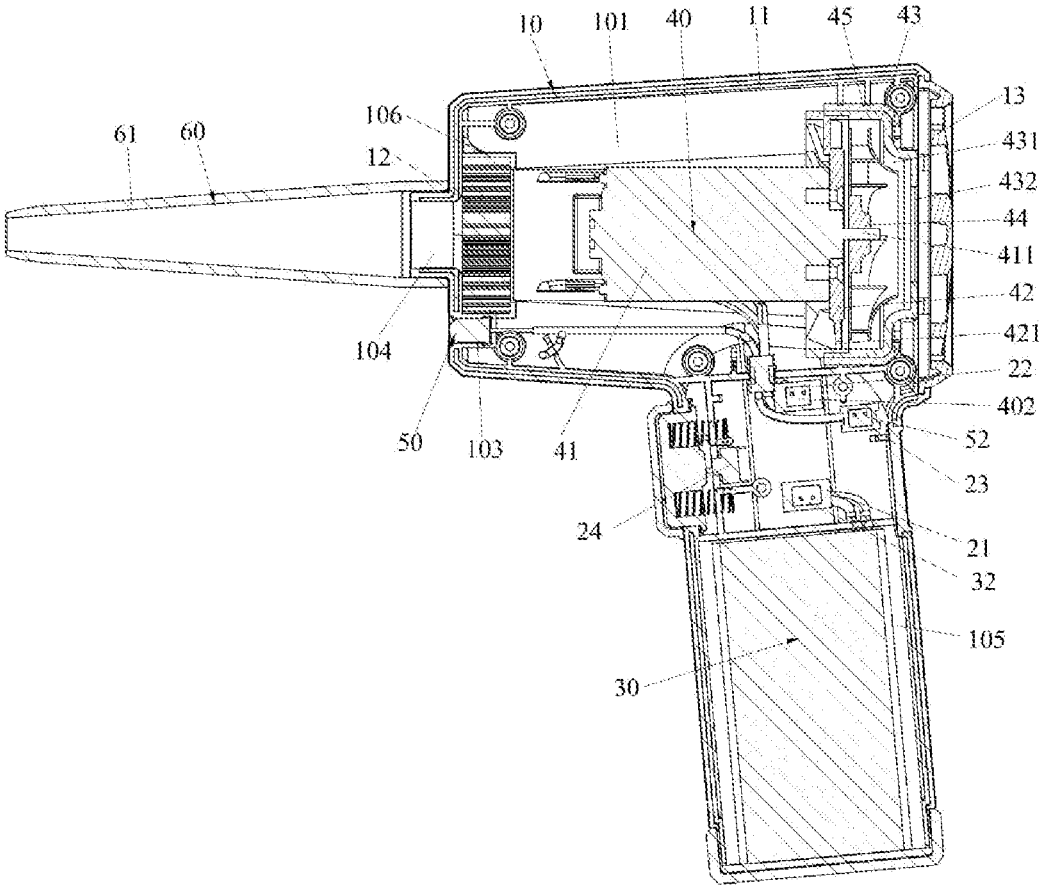
FIG. 5 is a sectional view of a preferred embodiment of the present disclosure.

Referring to FIG. 1 to FIG. 5, a specific structure of an electric dust blower according to a preferred embodiment of the present disclosure is illustrated. The electric dust blower includes a shell 10, a control panel 20, a battery module 30, a fan 40, an illumination lamp 50, and air outlet nozzles 60.

The shell 10 includes two half shells 11 capable of being spliced together left and right. Upper portions of the two half shells 11 are spliced to form a main body. An air chamber 101 is provided in the main body, and an inner diameter of the air chamber 101 is gradually reduced from rear to front. An air inlet 102 communicated with a rear end of the air chamber 101 is provided at a rear end face of the main body. A mounting hole 103 and an air outlet 104 communicated with a front end of the air chamber 101 are provided at a front end face of the main body. The mounting hole 103 is located beside the air outlet 104. Lower portions of the two half shells 11 are spliced to form a handle, and the handle integrally extends downwards out of a side face of a rear end of the main body. A mounting chamber 105 is provided within the handle. The upper portions of the two half shells 11 are fixedly connected together through a plurality of screws. Clamping portions 111 are disposed on inner walls of the two half shells 11 in a protruding manner. An accommodating slot 106 is provided inside a front end of the main body, and a sound-absorbing sponge 12 is placed in the accommodating slot 106. The sound-absorbing sponge 12 is located behind the air outlet 104 to absorb noise of an air flow, thereby achieving a better mute effect. An air inlet grill 13 is sandwiched between rear ends of the upper portions of the two half shells 11. The air inlet grill 13 is located behind the air inlet 102 to reduce noise generated when air enters the air inlet 102. Positioning slots 107 and a buckle slot 108 are provided at an outer wall of a lower end of the handle in a concave manner. The shell 10 further includes a bottom cap 14. Positioning portions 141 and a buckle portion 142 are provided on an inner wall of the bottom cap 14 in a protruding manner. The positioning portions 141 are inserted into the positioning slots 107 for positioning, and the buckle portion 142 is fit with the buckle slot 108 for buckling and fixation, such that the assembly is convenient, fast and stable.

The control panel 20 is disposed at an upper portion of the mounting chamber 105. The control panel 20 has a first interface 21, a second interface 22, a third interface 23, and a control switch 24. The control switch 24 is exposed out of a front side face of an upper end of the handle. In this embodiment, the control panel 20 has a charging interface 25, and the charging interface 25 is exposed out of a rear side face of the upper end of the handle for charging of the battery module 30.

The battery module 30 is disposed at a lower portion of the mounting chamber 105. The battery module 30 has a first connecting line 31. The first connecting line 31 has a first plug 32 at a tail end. The first plug 32 is in plug-in connection with the first interface 21 for conduction.

The fan 40 is disposed at a rear portion of the air chamber 101 and is close to the air inlet 102. The fan 40 has a second connecting line 401. The second connecting line 401 has a second plug 402 at a tail end. The second plug 402 is in plug-in connection with the second interface 22 for conduction. Specifically, the fan 40 includes a motor 41, an air guide rear cover 42, an air guide front housing 43, and an impeller 44. The motor 41 is fixed in the air chamber 101. The air guide rear cover 42 is fixed to a front end of the motor 41. A plurality of air guide holes 421 are provided at a periphery of the air guide rear cover 42. The air guide front housing 43 is located on a front side of the air guide rear cover 42 and spliced with the air guide rear cover 42 to define a cavity 431. An air inlet hole 432 communicated with the cavity 431 is provided at a center of a front end of the air guide front housing 43. The air inlet hole 432 is opposite to the air inlet 102. The air guide front housing 43 is wrapped with an anti-vibration sponge 45. The anti-vibration sponge 45 is clamped between an outer wall of the air guide front housing 43 and an inner wall of the air chamber 101 to achieve anti-vibration and noise reduction effects. The impeller 44 is fixed to an output shaft 411 of the motor 41 and located in the cavity 431. A rear end of the motor 41 faces the air outlet 104, and vibration-damping silicone components 46 are sandwiched between an outer wall of the rear end of the motor 41 and the inner wall of the air chamber 101 to achieve vibration-damping mounting of the motor 41 and avoid noise. In addition, the number of the vibration-damping silicone components 46 is two, and the two vibration-damping silicone components 46 are symmetrically disposed in a radial direction. The two vibration-damping silicone components 46 are respectively clamped to the corresponding clamping portions 111 for fixation, thereby achieving simple structure and convenient assembly.

The illumination lamp 50 is mounted in the mounting hole 103 and exposed out of the front end face of the main body. The illumination lamp 50 has a third connecting line 51. The third connecting line 51 has a third plug 52 at a tail end. The third plug 52 is in plug-in connection with the third interface 23 for conduction. In this embodiment, the illumination lamp 50 is an LED lamp, and the illumination lamp 50 is located below the air outlet 104.

The air outlet nozzles 60 are detachably mounted at and connected to the air outlet 104. In this embodiment, a plurality of air outlet nozzles 60 are provided, including a first air outlet nozzle 61, a second air outlet nozzle 62, a third air outlet nozzle 63, a fourth air outlet nozzle 64, and a fifth air outlet nozzle 65 respectively. The first air outlet nozzle 61, the second air outlet nozzle 62, the third air outlet nozzle 63, the fourth air outlet nozzle 64 and the fifth air outlet nozzle 65 are respectively detachably disposed at the air outlet 104. The first air outlet nozzle 61 and the second air outlet nozzle 62 are conical, an output end of the first air outlet nozzle 61 and an output end of the second air outlet nozzle 62 are circular, and a length of the first air outlet nozzle 61 is greater than a length of the second air outlet nozzle 62. An output end of the third air outlet nozzle 63 is oval. A front end of the fourth air outlet nozzle 64 is flat, and air outlet holes 641 communicated with an air duct inside the fourth air outlet nozzle 64 are provided on two sides of the front end of the fourth air outlet nozzle 64. Bristles 651 are disposed at a periphery of an output end of the fifth air outlet nozzle 65 to brush off dust, etc. from objects.

The present disclosure further discloses a modular assembly method of the above-mentioned electric dust blower. The method includes the following steps:

(1) Preparing a shell 10, a control panel 20, a battery module 30, a fan 40, an illumination lamp 50, and air outlet nozzles 60.

(2) Taking one of half shells 11, and fixing the control panel 20, the battery module 30, the fan 40 and the illumination lamp 50 to corresponding positions on the half shell 11 respectively.

(3) Plugging a first plug 32, a second plug 402 and a third plug 52 to a first interface 21, a second interface 22 and a third interface 23 respectively for conduction.

(4) Splicing and fixing the other half shell 11 and the half shell 11 of step (2) together.

(5) Performing plug-in connection and fixation on the air outlet nozzles 60 and an air outlet 104.

The use method of this embodiment is described in detail as follows:

During use, the first air outlet nozzle 61, the second air outlet nozzle 62, the third air outlet nozzle 63, the fourth air outlet nozzle 64 or the fifth air outlet nozzle 65 is selected according to the requirements of use, and is mounted at and connected to the air outlet 104. Then, the upper end of the handle is held by a hand, the control switch 24 is pressed, and the battery module 30 supplies power to the fan 40 and the illumination lamp 50 through the control panel 20. The fan 40 operates to accelerate air entering from the air inlet 102 to form wind, and the wind is output from the air outlet 104 and is then blown to an external object through the air outlet nozzle 65, so as to blow away impurities such as dust and like on the external object. Meanwhile, the illumination lamp 50 is turned on, and light generated by the illumination lamp illuminates the object ahead, such that a user can clearly see the external object in poor light, which is more conductive to the dust blowing operation.

The design emphasis of the present disclosure is: Firstly, since the battery module is disposed at the lower portion of the mounting chamber, and the fan is disposed at the rear portion of the air chamber and is close to the air inlet, the overall center of gravity of the product coincides with a handheld part of the handle, and the product is not prone to shaking when held by a hand, thereby having better stability and being more convenient to use. Meanwhile, by disposing the various interfaces on the control panel, the various plugs of the battery module, the fan and the illumination lamp are plugged to the corresponding interfaces respectively, such that the modular assembly is achieved, the welding operation is not required, the assembly is easier and more convenient, and the assembly efficiency is effectively improved. Secondly, the impeller is disposed in the cavity formed by the air guide rear cover and the air guide front housing, the anti-vibration sponge and the vibration-damping silicone components are disposed to absorb noise generated by the fan, and meanwhile, the sound-absorbing sponge is disposed to absorb noise generated by the air flow, such that the noise generated by the product is effectively reduced, a mute effect is achieved, and the use performance of the product is greatly improved.

The technical principles of the present disclosure have been described above in conjunction with the specific embodiments. These descriptions are merely illustrative of the principles of the present disclosure and are not to be construed as limiting the scope of protection of the present disclosure in any way. Based on the explanations herein, a person skilled in the art would have been able to conceive other specific implementations of the present disclosure without involving any inventive effort, which would all fall within the scope of protection of the present disclosure.

What is claimed is:

1. An electric dust blower, comprising a shell, a control panel, a battery module, a fan, an illumination lamp, and air outlet nozzles, wherein the shell comprises two half shells capable of being spliced together left and right; upper portions of the two half shells are spliced to form a main body; an air chamber is disposed in the main body; an inner diameter of the air chamber is gradually reduced from rear to front; an air inlet communicated with a rear end of the air chamber is disposed at a rear end face of the main body; a mounting hole and an air outlet communicated with a front end of the air chamber are disposed at a front end face of the main body; the mounting hole is located beside the air outlet; lower portions of the two half shells are spliced to form a handle, the handle integrally extends downwards out of a side face of a rear end of the main body; and a mounting chamber is disposed within the handle;

the control panel is disposed at an upper portion of the mounting chamber; the control panel has a first interface, a second interface, a third interface, and a control switch; and the control switch is exposed out of a front side face of an upper end of the handle;

the battery module is disposed at a lower portion of the mounting chamber; the battery module has a first connecting line that has a first plug at a tail end; and the first plug is in plug-in connection with the first interface for conduction;

the fan is disposed at a rear portion of the air chamber and is close to the air inlet; the fan has a second connecting line that has a second plug at a tail end; and the second plug is in plug-in connection with the second interface for conduction;

the illumination lamp is mounted in the mounting hole and exposed out of the front end face of the main body; the illumination lamp has a third connecting line that has a third plug at a tail end; and the third plug is in plug-in connection with the third interface for conduction; and the air outlet nozzles are detachably mounted at and connected to the air outlet.

2. The electric dust blower of claim 1, wherein the fan comprises a motor, an air guide rear cover, an air guide front housing, and an impeller; the motor is fixed in the air chamber; the air guide rear cover is fixed to a front end of the motor; a plurality of air guide holes are provided at a periphery of the air guide rear cover; the air guide front housing is located on a front side of the air guide rear cover and spliced with the air guide rear cover to define a cavity, an air inlet hole communicated with the cavity is provided at a center of a front end of the air guide front housing; the air inlet hole is opposite to the air inlet; the air guide front housing is wrapped with an anti-vibration sponge; the anti-vibration sponge is clamped between an outer wall of the air guide front housing and an inner wall of the air chamber; and the impeller is fixed to an output shaft of the motor and located in the cavity.

3. The electric dust blower of claim 2, wherein a rear end of the motor faces the air outlet, and vibration-damping silicone components are sandwiched between an outer wall of the rear end of the motor and the inner wall of the air chamber.

4. The electric dust blower of claim 3, wherein the number of the vibration-damping silicone components is two, and the two vibration-damping silicone components are symmetrically disposed in a radial direction; clamping portions are disposed on inner walls of the two half shells in a protruding manner; and the two vibration-damping silicone components are respectively clamped to the corresponding clamping portions for fixation.

5. The electric dust blower of claim 3, wherein an accommodating slot is provided inside a front end of the main body, a sound-absorbing sponge is placed in the accommodating slot, and the sound-absorbing sponge is located behind the air outlet.

6. The electric dust blower of claim 1, wherein an air inlet grill is sandwiched between rear ends of the upper portions of the two half shells, and the air inlet grill is located behind the air inlet.

7. The electric dust blower of claim 1, wherein positioning slots and a buckle slot are provided in an outer wall of a lower end of the handle in a concave manner; the shell further comprises a bottom cap; positioning portions and a buckle portion are disposed on an inner wall of the bottom cap in a protruding manner; the positioning portions are inserted into the positioning slots for positioning; and the buckle portion is fit with the buckle slot for buckling and fixation.

8. The electric dust blower of claim 1, wherein the control panel has a charging interface that is exposed out of a rear side face of the upper end of the handle.

9. The electric dust blower of claim 1, wherein a plurality of air outlet nozzles are provided, including a first air outlet nozzle, a second air outlet nozzle, a third air outlet nozzle, a fourth air outlet nozzle, and a fifth air outlet nozzle respectively; the first air outlet nozzle, the second air outlet nozzle, the third air outlet nozzle, the fourth air outlet nozzle and the fifth air outlet nozzle are respectively detachably disposed at the air outlet, wherein the first air outlet nozzle and the second air outlet nozzle are conical, an output end of the first air outlet nozzle and an output end of the second air outlet nozzle are circular, and a length of the first air outlet nozzle is greater than a length of the second air outlet nozzle; an output end of the third air outlet nozzle is oval; a front end of the fourth air outlet nozzle is flat, and air outlet holes communicated with an air duct inside the fourth air outlet nozzle are provided on two sides of the front end of the fourth air outlet nozzle; and bristles are disposed at a periphery of an output end of the fifth air outlet nozzle.

10. A modular assembly method of the electric dust blower of claim 1, comprising the following steps:

(1) preparing a shell, a control panel, a battery module, a fan, an illumination lamp, and air outlet nozzles;

(2) taking one of half shells, and fixing the control panel, the battery module, the fan and the illumination lamp to corresponding positions on the half shell respectively;

(3) plugging a first plug, a second plug and a third plug to a first interface, a second interface and a third interface respectively for conduction;

(4) splicing and fixing the other half shell and the half shell of step (2) together; and (5) performing plug-in connection and fixation on the air outlet nozzles and an air outlet.

* * * * *